US005654940A

United States Patent [19]

Wei

[11] Patent Number: 5,654,940

[45] Date of Patent: Aug. 5, 1997

[54] MULTI-PURPOSE CLOCK

[76] Inventor: Chao-Chia Wei, No. 784, Fu Kuo Road, Sec. 2, Lu Chu Hsiang, Tao-Yuan Hsien, Taiwan

[21] Appl. No.: 645,814

[22] Filed: May 14, 1996

[51] Int. Cl.[6] ..... G04B 19/24; G04B 19/00; G04B 19/06

[52] U.S. Cl. ..... 368/28; 368/223; 368/232

[58] Field of Search ..... 368/28, 39, 40, 368/76, 80, 223, 228, 231, 232

[56] References Cited

U.S. PATENT DOCUMENTS

| | | | |
|---|---|---|---|
| 347,337 | 8/1886 | Ethridge | 368/231 |
| 401,697 | 4/1889 | Ethridge | 368/231 |
| 4,709,493 | 12/1987 | Sapp | 40/117 |
| 4,993,006 | 2/1991 | Oshima et al. | 368/231 |
| 5,124,959 | 6/1992 | Yamazaki et al. | 368/231 |

*Primary Examiner*—Yit W. Miska

*Attorney, Agent, or Firm*—Morton J. Rosenberg; David I. Klein

[57] ABSTRACT

A multi-purpose clock including a known clock movement and a clock body accommodating the clock movement. The clock body has at least twelve hollow compartments disposed at the positions of the hours numerals. Each hollow compartment contains a turnable, block which is pivotally disposed therein by means of a couple of positioning element. Each block has at least one side showing an hour numeral and at least one side showing a list of the days of the corresponding calendar month. The blocks may also display various patterns to provide greater variety.

10 Claims, 6 Drawing Sheets

MULTI-PURPOSE CLOCK

BACKGROUND OF THE INVENTION (a) Field of the Invention

The present invention relates generally to a clock structure, and more particularly to a multi-purpose clock capable of displaying not only the time and dates but also desirable pictures or patterns.

(b) Description of the Prior Art

Conventional clocks generally have a single function, i.e., displaying the time. Some clocks can show the date as well. Furthermore, the conventional clock can only display time in Arabic numerals or Roman numerals, not both. Besides, the numerals are fixedly printed or marked on the clock face so that the user cannot replace the Arabic numerals with the Roman numerals, or vice versa, at will. For decades, the design of clocks or the dials has remained almost unchanged, which is monotonous and lacks variety.

SUMMARY OF THE INVENTION

Accordingly, a primary object of the invention is to provide a multi-purpose clock in which a clock body has at least twelve hollow compartments, each of which pivotally holds a block marked with an hour numeral and a list of days of a corresponding calendar month on its sides, arranged at appropriate positions to show not only the time of the day but also the days of the month.

Another object of the present invention is to provide a multi-purpose clock in which both Arabic numerals and Roman numerals may be displayed to indicate the time.

A further object of the present invention is to provide a multi-purpose clock in which a clock body is provided with a plurality of hollow compartments each pivotally holding a block marked with various patterns.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
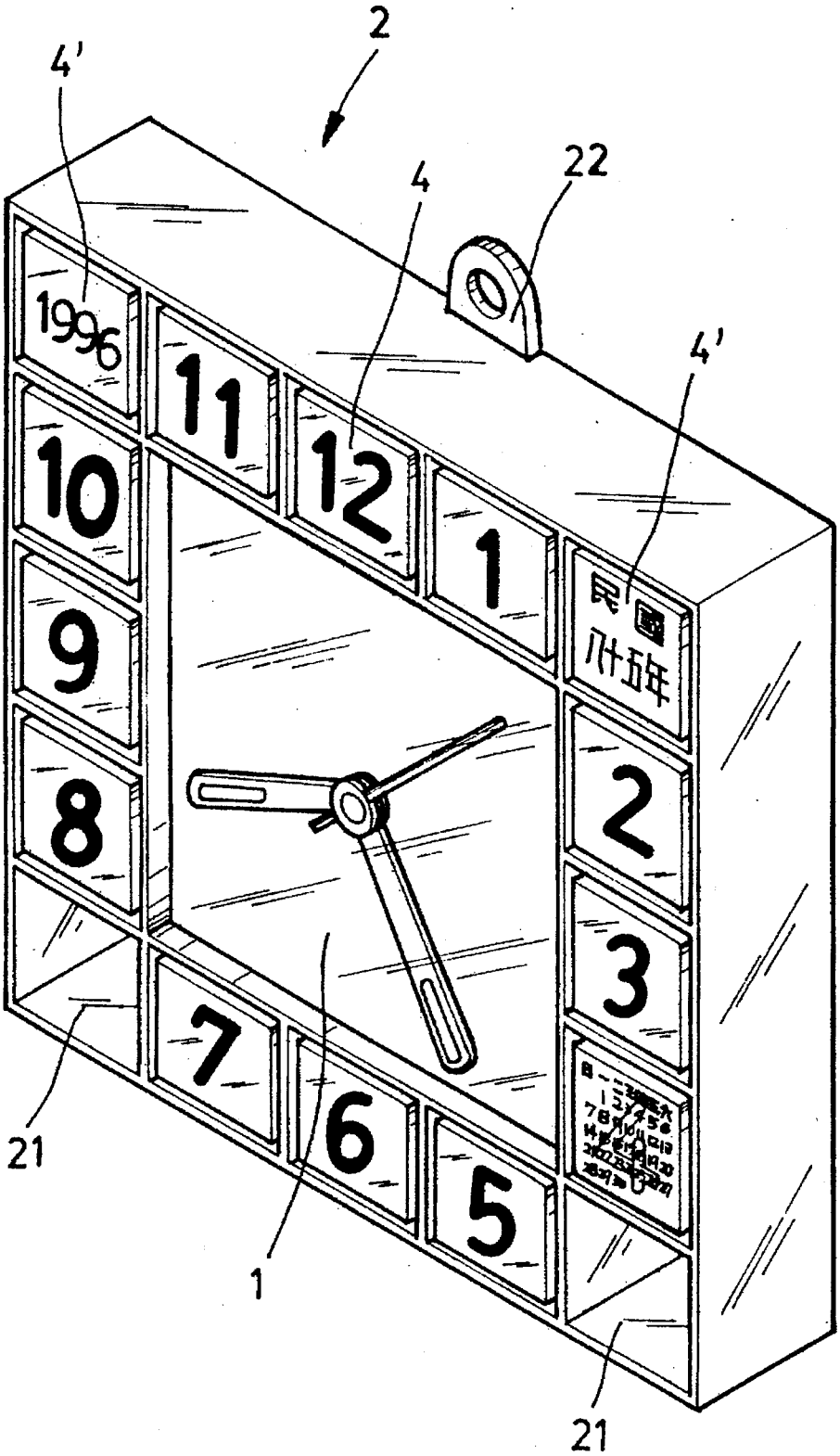
FIG. 1 is an elevational view of a preferred embodiment of the multi-purpose clock of the present invention.
Figure 2:
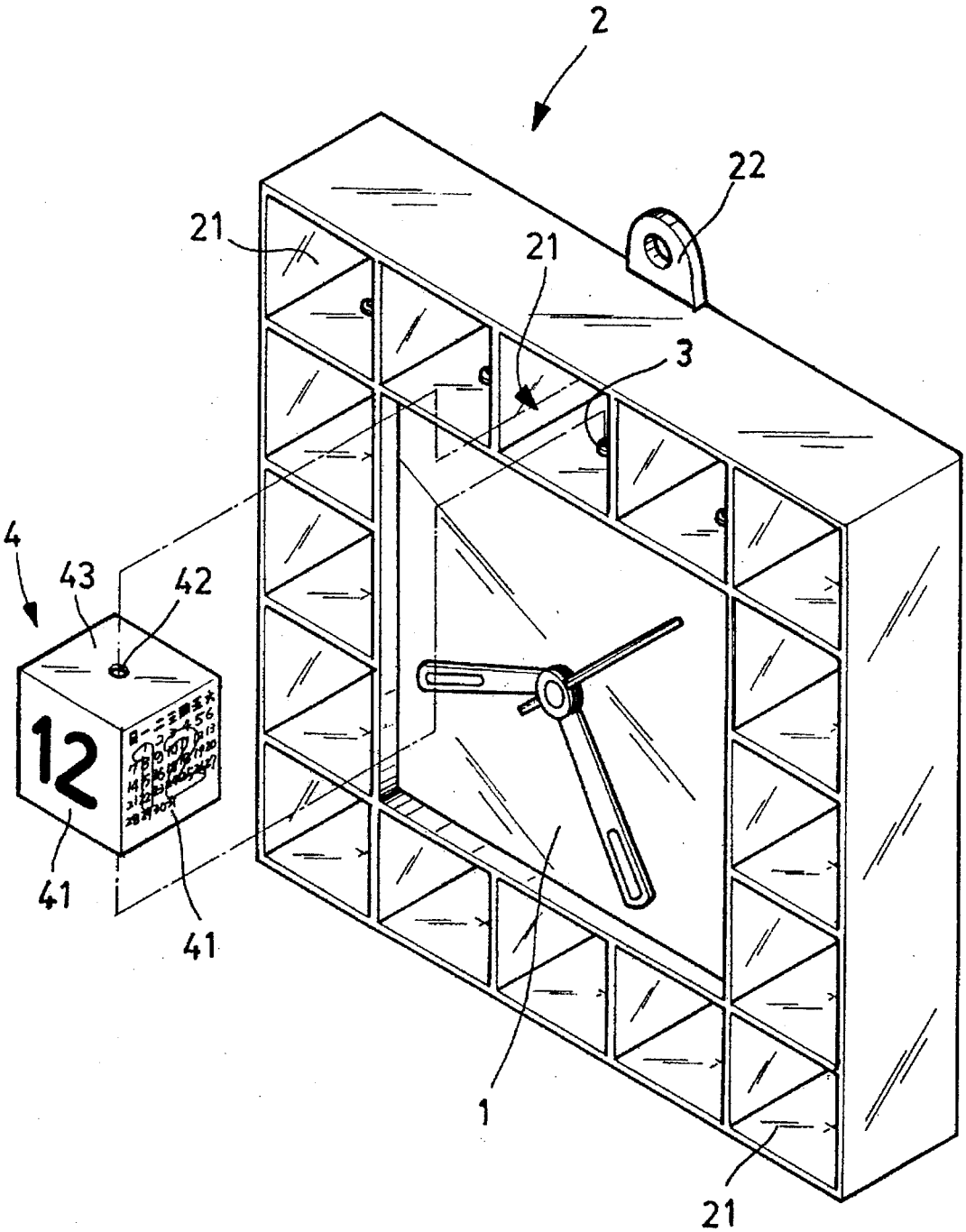
FIG. 2 is a schematic, elevational view of the preferred embodiment of the multi-purpose clock of the invention.

With reference to FIGS. 1–4, a preferred embodiment of the multi-purpose clock of the present invention essentially comprises a clock movement 1 and a clock body 2 for accommodating the clock movement 1.

The clock body 2 around the clock movement 1 is provided with a plurality of hollow compartments 21 of identical size at suitable locations. Each hollow compartment 1 has at least one positioning element 3 by which a block that is a polygonal prism, such as a cubic block 4 in this preferred embodiment, may be pivotally disposed within the hollow compartment 1 and turnably move therein. At least one side 41 of the block 4 is marked with an hour numeral and at least one side 41 of the block 4 is marked with a list of the days of a calendar month corresponding to the hour numeral appearing on another side. For instance, a block 4 may have one side 41 marked with the hour numeral 12 and another side 41 marked with a list of the days of December. By means of this arrangement, twelve blocks 4 may be used to indicate not only the twelve hour numerals but also the twelve calendar months.

Furthermore, the clock body 2 is provided with at least twelve hollow compartments 21 so as to display the twelve hour numerals and the twelve calendar months. In the preferred embodiment shown in FIG. 1, the clock body 2 is quadrilateral and its four corners may be molded to be closed or provided with hollow compartments 21. The hollow compartments 21 may be adapted for placement of small items or ornaments. Alternatively, blocks 4 marked with the year or other patterns may be disposed therein.

Additionally, the hour numerals, calendars or patterns on the sides 41 of the blocks 4 may be directly printed on the blocks 4 or stickers showing the same may be adhered thereto.

Figure 3:
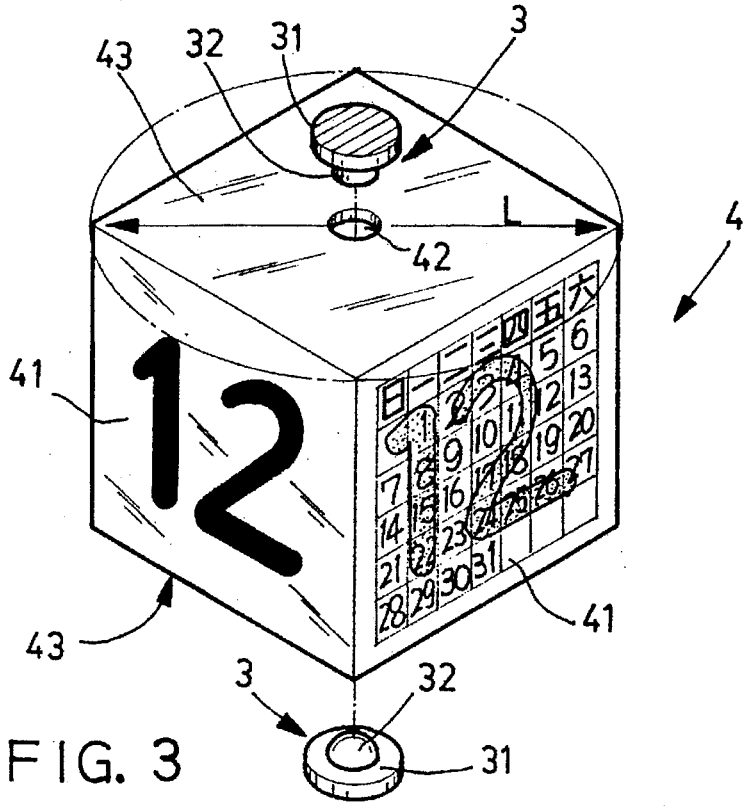
FIG. 3 is an elevational view of a block of the multi-purpose clock of the present invention.
Figure 4:
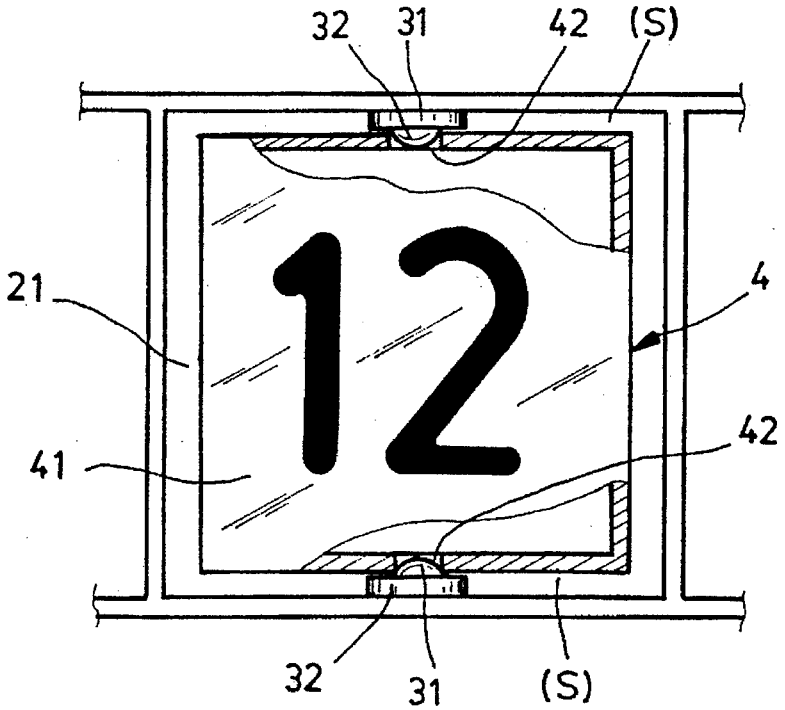
FIG. 4 is a schematic view of the block positioned by a couple of positioning elements in a hollow compartment of the multi-purpose clock of the present invention.

Referring to FIGS. 3 and 4, each block 4 has a central axis which may be configured to have a through hole 42 or a slot at either end for receiving the positioning element 3. The positioning elements 3 may be arranged on the hollow compartment 21 during molding of the hollow compartment 21. In this preferred embodiment, each hollow compartment 21 is provided with two positioning elements 3, on at the upper side, the other at the lower side. Each positioning element 3 consists of a seat 31 and a raised, stop nose 32 on one side thereof. The positioning elements 3 are protrudently disposed at the upper and lower sides of the hollow compartment 21 such that the stop noses 32 of two opposite positioning elements 3 face each other and engage the through holes 42 or slot of the block 4 so that the block 4 may turn thereon. A clearance S is maintained between the upper (lower) side of the hollow compartment 21 and the upper (lower) side of the block 4 so as to facilitate turning of the block 4 and to maintain its stability.

As shown in FIG. 3, a diagonal L of the block 4 must not be greater than the width of the hollow compartment 21 so that it may rotate smoothly therein. When the block 4 is fitted into the hollow compartment 21, by means of the resilience of the block 4 itself and that of the hollow compartment 21, the stop noses 32 may easily slip into the respective through holes 42 or slot of the block 4.

The positioning element 3 may also be configured to be a pin for direct insertion into the hollow compartment 21 or pivotally mounting the block 4.

Figure 5:
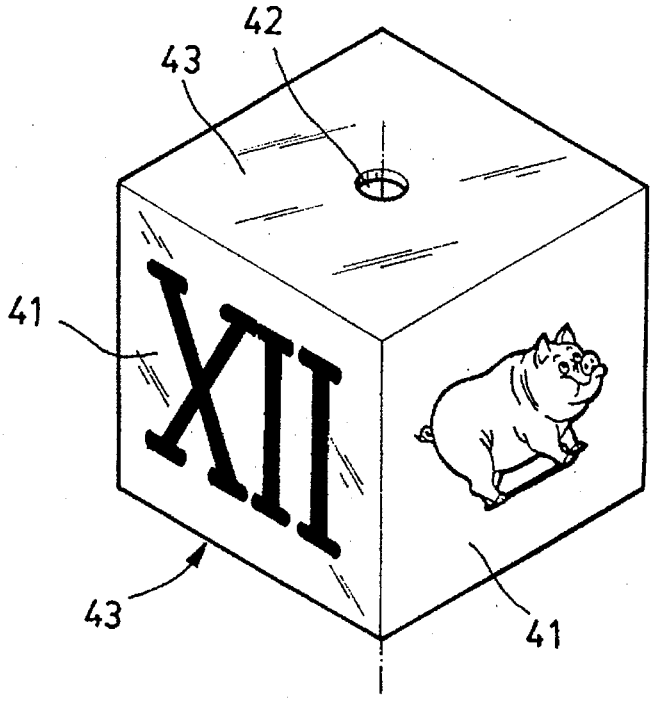
FIG. 5 is an elevational view of the block of the multi-purpose clock of the present invention taken from a different angle.
Figure 6:
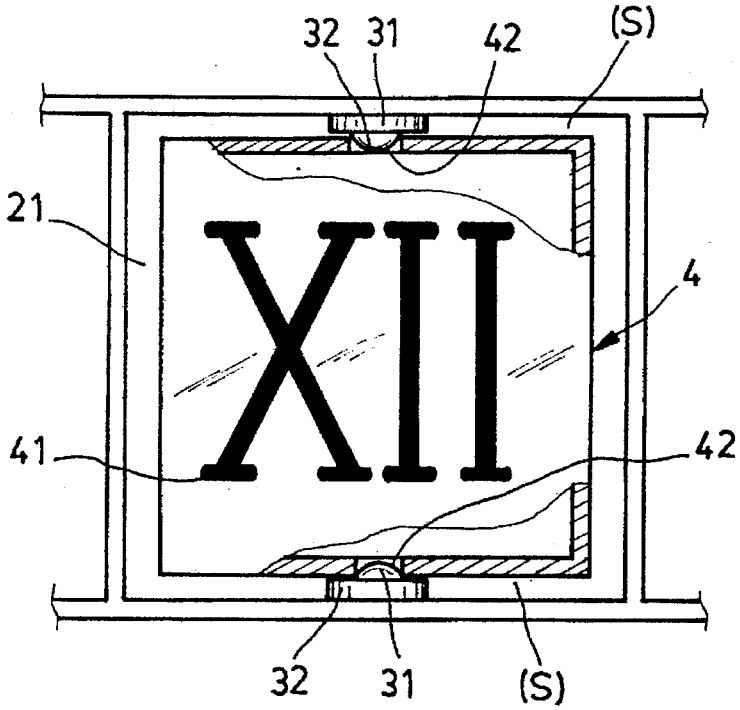
FIG. 6 is similar to FIG. 4, but showing another side of the block of the multi-purpose clock of the present invention.

Referring to FIG. 3, the block 4 has two sides respectively showing the Arabic numeral 12 and a list of days of December. In FIG. 5, the block 4 has the other two sides marked with the Roman numeral XII and a pig design representing the year of the pig according to the Chinese lunar calendar. The user may therefore turn the block 4 to display the selected side 41 as desired.

Figure 7:
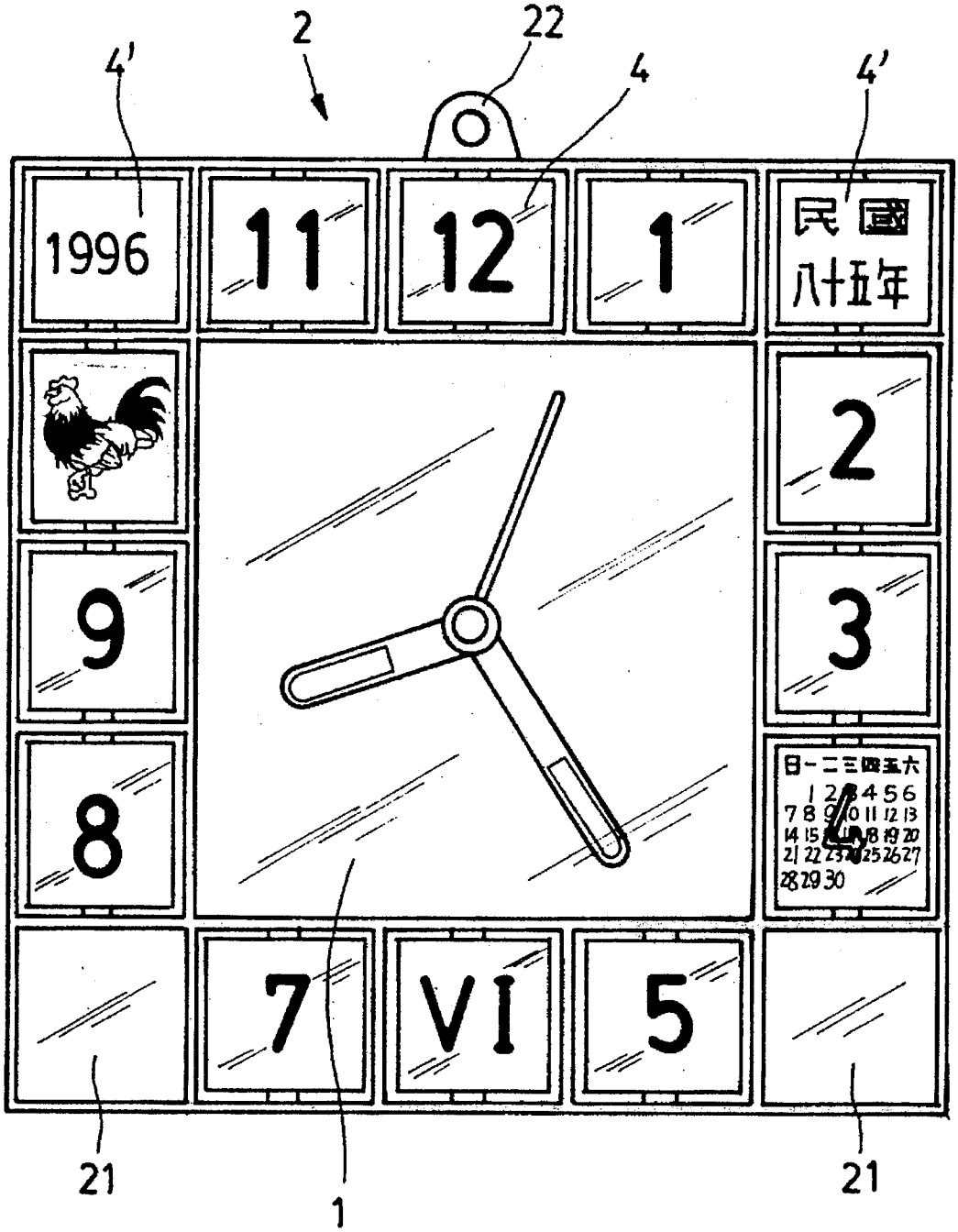
FIG. 7 is a front view of the the multi-purpose clock of the present invention.

With reference to FIG. 7 showing the face of the clock body 2, a list of days of April is displayed instead of the Arabic numeral 4; the Roman numeral VI takes the place of the Arabic numeral 6; and a rooster design (coming in the tenth place according to the Chinese lunar calendar) appears at the position 10. Obviously, it can be understood that this is merely an example of the multi-purpose clock of the invention. The sides of the block 4 may be provided with various patterns such as the signs of the zodiac or cartoon stars. Take for instance that the multi-purpose clock of the invention has a total of twelve blocks 4, each of which has four sides 41, there will be altogether $4^{12}$ combinations.

Furthermore, the block 4 may be configured to be a trigonal or hexahedronal structure, if desired.

Figure 8:
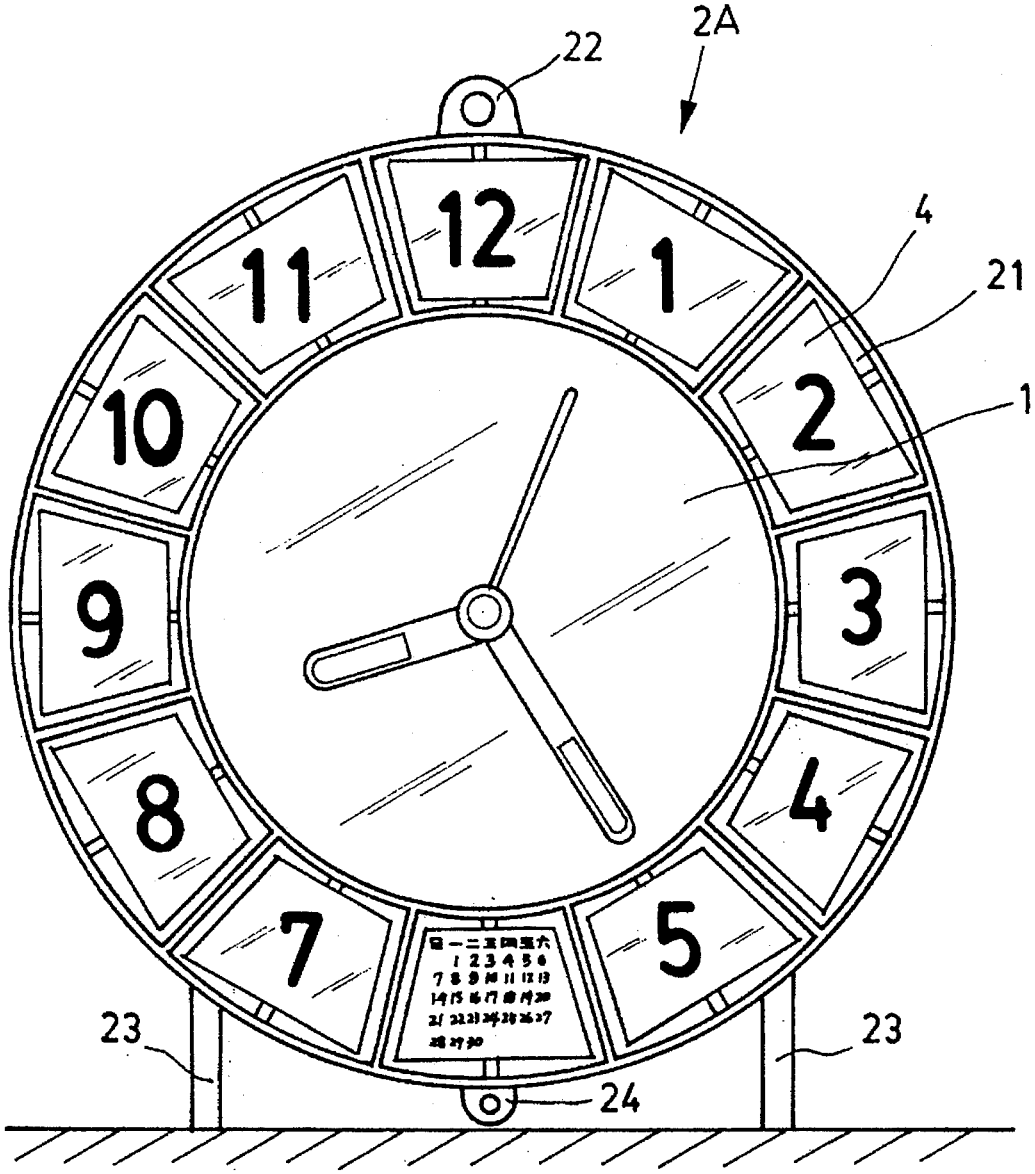
FIG. 8 is front view of another preferred embodiment of the the multi-purpose clock of the present invention.

Referring to FIG. 8, which shows another preferred embodiment of the clock body 2, the clock body 2 is configured to be a circular body 2A. It may also be designed to have various shapes, such as rectangular, square, etc.

The advantages achievable by the multi-purpose clock according to the present invention may be summarized as follows:

1. The twelve hour numerals are ingeniously combined with the twelve calendar months. For instance, referring to FIG. 1, the block 4 is marked with the hour numeral 4 one side and the days of April in 1996 on another side, while the block at an upper corner is marked with the year 1996. Such an arrangement provides convenience and practicality.
2. Selected patterns may be arranged on the other sides 41 of the block 4 to provide variety to the user.
3. The overall size of the multi-purpose clock of the invention is compact. It may be provided with a mounting lug 22 at an upper end therefor for hanging purposes or it may be placed on the desk and the like. For the circular clock body 2A shown in FIG. 8, it may be further provided with a couple of legs for supporting it firmly on the desk or the like. The circular clock body 2A may also be provided with a connecting lug 24 at a bottom end thereof, thereby decorative accessories may be connected to the clock body 2A when the clock is hung on the wall.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-purpose clock of the type comprising a known clock movement and a clock body accommodating said clock movement, wherein said clock body around said clock movement is provided with a plurality of hollow compartments of identical size, twelve of said hollow compartments each accommodating a block being located at positions corresponding to the twelve hour numerals on a clock face, said block being a polygonal prism having at least one side marked with an hour numeral and at least one side marked with a list of days of the corresponding calendar month, said block being pivotally mounted in said hollow compartment by means of a positioning means such that said block is capable of rotating within said hollow compartment.

2. The multi-purpose clock as claimed in claim 1, wherein said clock body further includes at least one block marked with the year and at least one block marked with a decorative design, said blocks being accommodated within the corresponding hollow compartments.

3. The multi-purpose clock as claimed in claim 1, wherein said block has a through hole at either end of a central axis thereof for receiving said positioning means.

4. The multi-purpose clock as claimed in claim 1, wherein said positioning means consists of a positioning seat and a nose on one side thereof and said positioning means may be provided on an upper side and a lower side of each of said hollow compartments during molding such that said noses of said positioning means face each other.

5. The multi-purpose clock as claimed in claim 1, wherein said positioning means may be configured to be a pin for direct insertion into each of said hollow compartments or for pivotally mounting said block.

6. The multi-purpose clock as claimed in claim 1, wherein said block is trigonal.

7. The multi-purpose clock as claimed in claim 1, wherein said block is hexahedronal.

8. The multi-purpose clock as claimed in claim 1, wherein said clock body is circular.

9. The multi-purpose clock as claimed in claim 1, wherein said clock body is rectangular.

10. The multi-purpose clock as claimed in claim 1, wherein said clock body is square.

* * * * *